US006957753B2

(12) United States Patent
Tani

(10) Patent No.: US 6,957,753 B2
(45) Date of Patent: Oct. 25, 2005

(54) MOVABLE BODY FEEDING APPARATUS

(75) Inventor: Yoshikazu Tani, Kita-ku (JP)

(73) Assignee: Tokiwa Corporation, Gifu (JP)

( * ) Notice: Subject to any disclaimer, the term of this patent is extended or adjusted under 35 U.S.C. 154(b) by 0 days.

(21) Appl. No.: 11/043,108

(22) Filed: Jan. 27, 2005

(65) Prior Publication Data

US 2005/0178800 A1 Aug. 18, 2005

(30) Foreign Application Priority Data

Feb. 18, 2004 (JP) ..... 2004-041966

(51) Int. Cl.[7] ..... A46B 11/02
(52) U.S. Cl. ..... 222/390; 401/172; 401/174
(58) Field of Search ..... 401/74, 172, 174; 222/390

(56) References Cited

U.S. PATENT DOCUMENTS 3,756,730 A * 9/1973 Spatz ..... 401/174
4,997,299 A * 3/1991 Ohba ..... 401/172
5,085,352 A * 2/1992 Sasaki et al. ..... 222/390
6,569,126 B1 * 5/2003 Poulsen et al. ..... 222/390
6,793,431 B1 * 9/2004 Tsai ..... 401/172
6,811,062 B2 * 11/2004 Tani ..... 222/390
2003/0057236 A1 * 3/2003 Delage ..... 222/390
2004/0007599 A1 * 1/2004 Tani ..... 222/390
2004/0042841 A1 * 3/2004 Noguchi ..... 401/270

FOREIGN PATENT DOCUMENTS

GB 2211081 A * 6/1989 ..... A46B 11/02
JP 2000-262324 9/2000

* cited by examiner

*Primary Examiner*—Kenneth Bomberg
(74) *Attorney, Agent, or Firm*—Bacon & Thomas PLLC

(57) ABSTRACT

To provide a movable body feeding apparatus at a low cost by reducing a number of parts and making manufacturing process such as a molding, an assembling or the like simpler, the apparatus employs a tubular body (8) obtained by integrally forming a thread tube (8*a*), a ratchet gear (8*e*) in a side of a main body tube (1) and an elastic body (8*b*), instead of the conventional structure that a pair of ratchet gears are arranged between an engaging mechanism in a side of a main body tube and a compression coil spring, in which it is necessary to separate the engaging mechanism side and the compression coil spring side, and three parts (a plurality of parts) are required.

6 Claims, 18 Drawing Sheets

MOVABLE BODY FEEDING APPARATUS

TECHNICAL FIELD

The present invention relates to a movable body feeding apparatus in which a movable body arranged within a main body tube and an operating tube is sequentially fed out toward a leading end of the main body tube by relatively rotating the main body tube and the operating tube, and more particularly to a movable body feeding apparatus which is preferably used in a liquid filler extruding container or the like which a user appropriately extrudes an embedded liquid filler so as to use.

BACKGROUND ART

Conventionally, there has been known a movable body feeding apparatus provided with a main body tube, an operating tube which is provided in a rear end portion of the main body tube so as to be relatively rotatable and is provided with a rotation prevention extending in an axial direction on an inner peripheral surface thereof, a first tubular body which is engaged within the main body tube so as to be non-rotatable (be synchronously rotatable), has a female thread formed in an inner peripheral surface thereof and is provided with a ratchet gear in a rear end surface thereof, a second tubular body which is arranged between the first tubular body and the rotation prevention of the operating tube, is provided with a ratchet gear engaging with the ratchet gear of the first tubular body in a leading end surface thereof and is engaged with the operating tube so as to be non-rotatable, a compression coil spring which is arranged between the second tubular body and the rotation prevention of the operating tube and energizes the second tubular body toward the first tubular body in such a manner that the ratchet gears are engaged with each other, and a movable body which is received in the operating tube and the main body tube in such a manner as to extend through the first and second tubular bodies and the compression coil spring and has a male screw engaging with the female thread of the first tubular body and a rotation prevention engaging with the rotation prevention of the operating tube formed on an outer peripheral surface thereof so as to extend in an axial direction, wherein the movable body is sequentially fed to the leading end side on the basis of a relative rotation of the main body tube and the operating tube by the user (for example, refer to Japanese Unexamined Patent Publication No. 2000-262324).

However, in the apparatus described in Japanese Unexamined Patent Publication No. 2000-262324 mentioned above, since a number of the parts is comparatively large and a manufacturing such as a molding, an assembling or the like is complicated, it is desired to achieve a low cost.

SUMMARY OF THE INVENTION

The present invention is made in order to solve the problem mentioned above, and an object of the present invention is to provide a movable body feeding apparatus in which a low cost is achieved.

In accordance with the present invention, there is provided a movable body feeding apparatus comprising:

a main body tube;

a thread tube which is arranged within the main body tube, is engaged with the main body tube so as to be synchronously rotatable and has a female thread formed in an inner peripheral surface thereof;

a stick-shaped movable body in which a male screw engaging with the female thread is formed in an outer peripheral surface thereof;

an operating tube which is connected to a rear end side of the main body tube so as to be relatively rotatable and is provided with an engaging portion engaging the movable body so as to be synchronously rotatable and be slidable in an axial direction;

a pair of ratchet gears which are respectively provided in a side of the main body tube and a side of the operating tube; and an elastic body which energizes such that the ratchet gears are engaged with each other;

the movable body being sequentially fed on the basis of a relative rotation of the main body tube and the operating tube, wherein the movable body feeding apparatus is provided with a tubular body in which the thread tube, the ratchet gear in the main body tube side and the elastic body are integrally formed.

Conventionally, since the structure is made such that a pair of ratchet gears are arranged between the engaging mechanism in the main body tube side and the compression coil spring, in which it is necessary to separate the engaging mechanism side and the compression coil spring side and three parts (a plurality of parts) are required. However, in accordance with the movable body feeding apparatus mentioned above, since the thread tube, the ratchet gear in the main body tube side and the elastic body are integrally molded, it is possible to reduce the number of the parts, and the manufacturing process such as the molding, the assembling or the like can be easily executed.

In this case, as a particular structure effectively achieving the effect mentioned above, a pair of ratchet gears are arranged so as to oppose in an axial direction, the elastic body is constituted by a compression spring energizing in such a manner that the ratchet gears are engaged with each other, and the tubular body is constituted by an integrally molded product with a resin, has a thread tube in a leading end portion, has a main body tube side ratchet gear in a rear end portion, is integrally formed so as to have a compression spring connecting the leading end portion and the rear end portion, and is arranged so as to be pinched between the main body tube and the operating tube in such a manner that the movable body passes through an inner side thereof.

Further, as the ratchet gear in the operating tube side, there can be particularly shown, for example, a structure provided in the leading end surface of the operating tube.

Further, the engaging portion of the operating tube is provided at plural number in the inner peripheral surface of the operating tube so as to protrude to an inner side in a radial direction, and the leading end portion of the engaging portion of the operating tube is formed as the ratchet gear in the operating tube side. In this case, the engaging portion of the operating tube side serves both the rotation preventing function and the ratchet gear function, and it is unnecessary that the ratchet gear in the operating tube side is independently provided.

As mentioned above, in accordance with the movable body feeding apparatus on the basis of the present invention, the number of the parts can be reduced, the manufacturing process such as the molding, the assembling or the like is easily executed, and it is possible to achieve the low cost.

DESCRIPTION OF THE PREFERRED EMBODIMENTS

Figure 1:
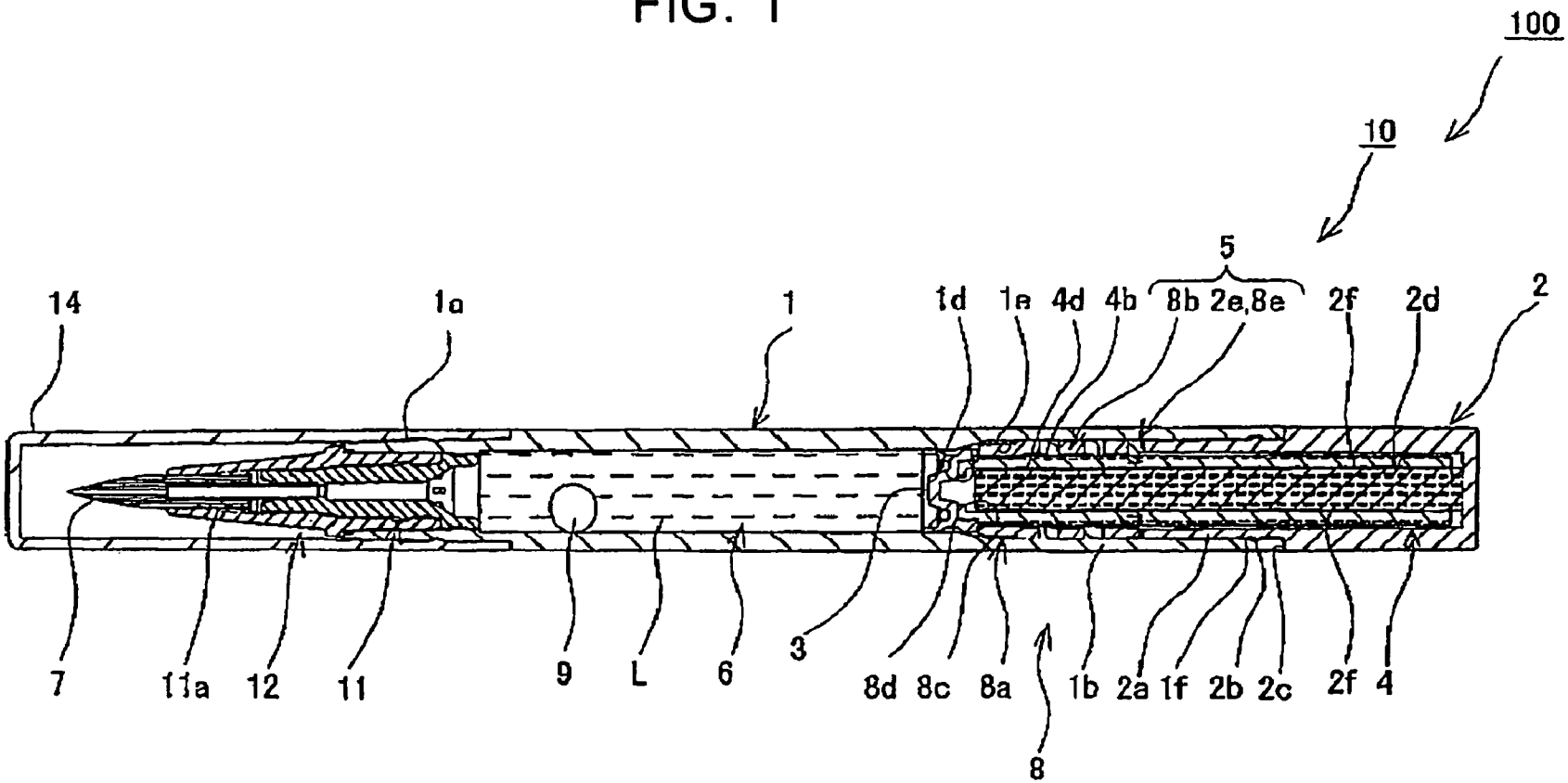
FIG. 1 is a cross sectional view showing a liquid filler extruding container to which a movable body feeding apparatus in accordance with a first embodiment of the present invention is applied, and shows a state before feeding the movable body.
Figure 2:
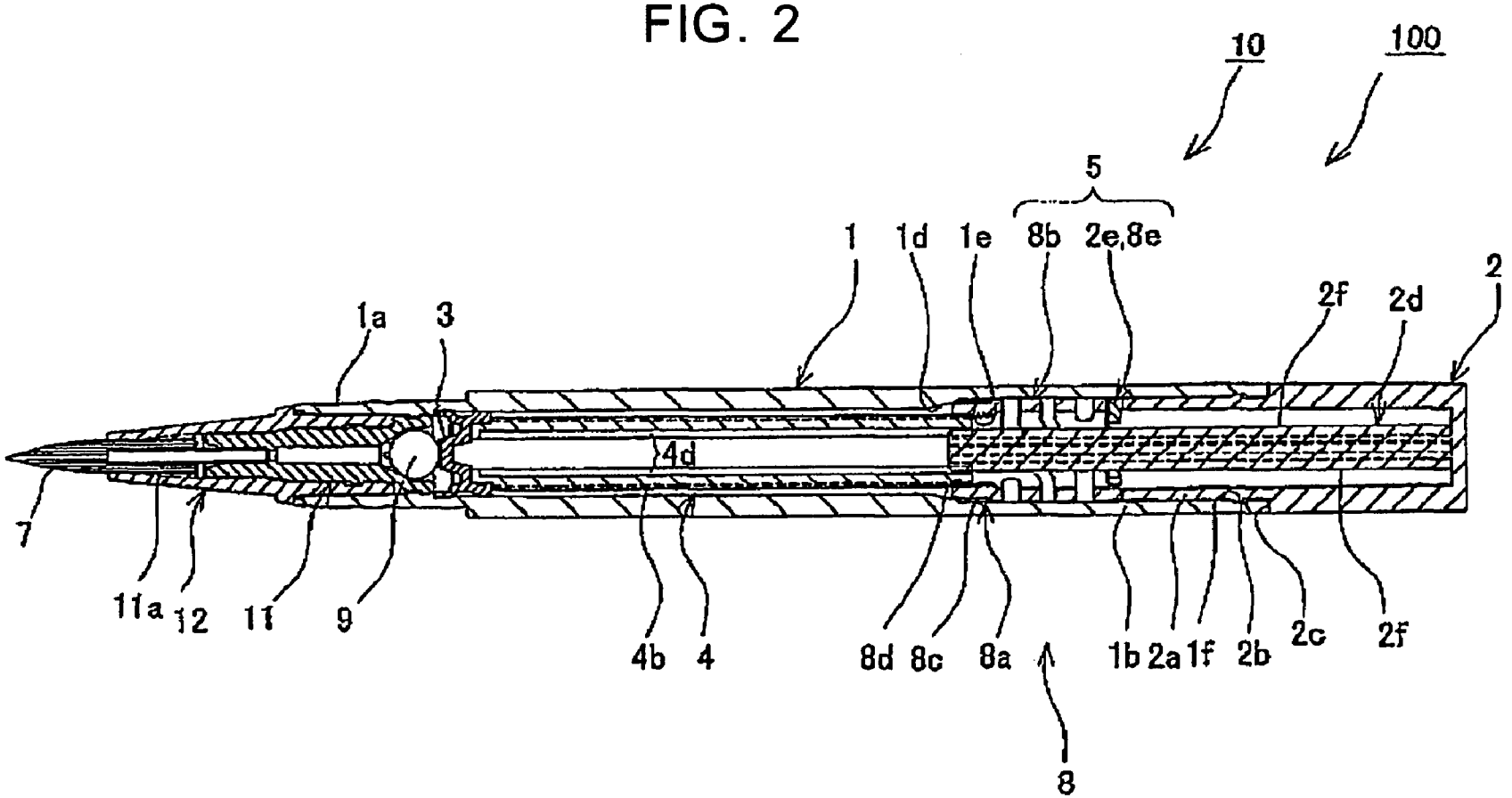
FIG. 2 is a cross sectional view showing the liquid filler extruding container to which the movable body feeding apparatus in accordance with the first embodiment of the present invention is applied, and shows a state in which the movable body is fed to a forward movement limit.
Figure 3:
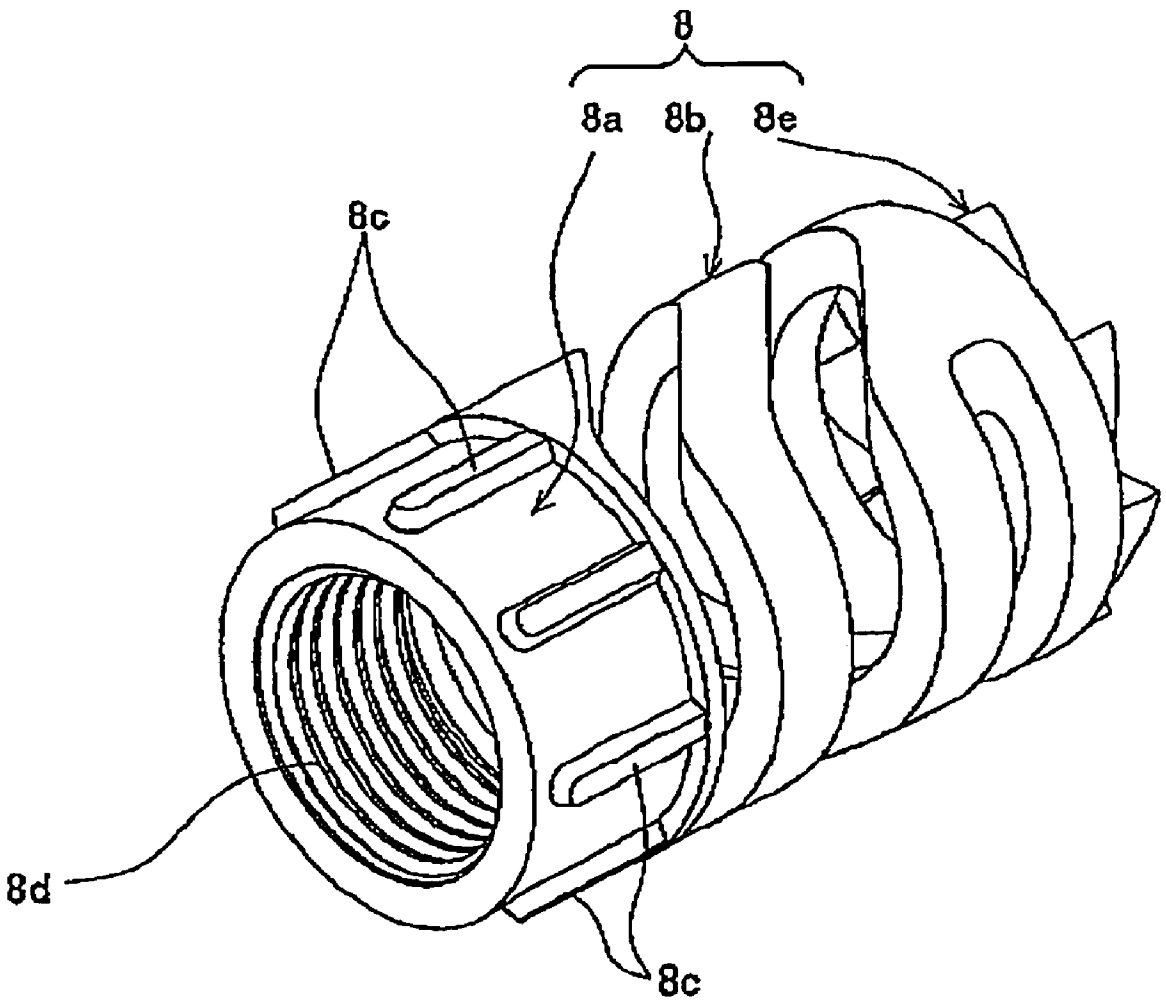
FIG. 3 is a forward perspective view showing a tubular body in FIGS. 1 and 2.
Figure 4:
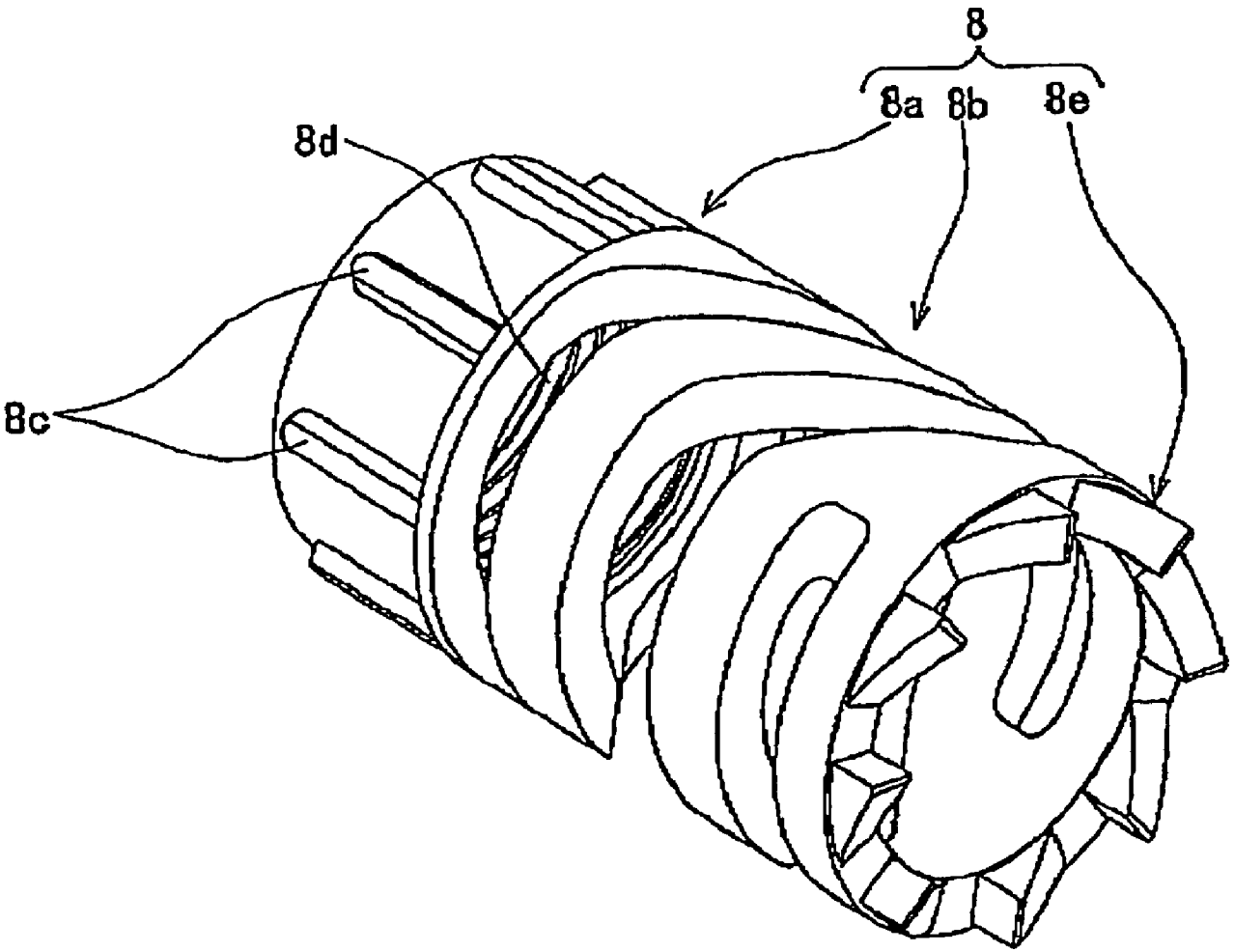
FIG. 4 is a rearward perspective view of the tubular body in FIG. 3.
Figure 5:
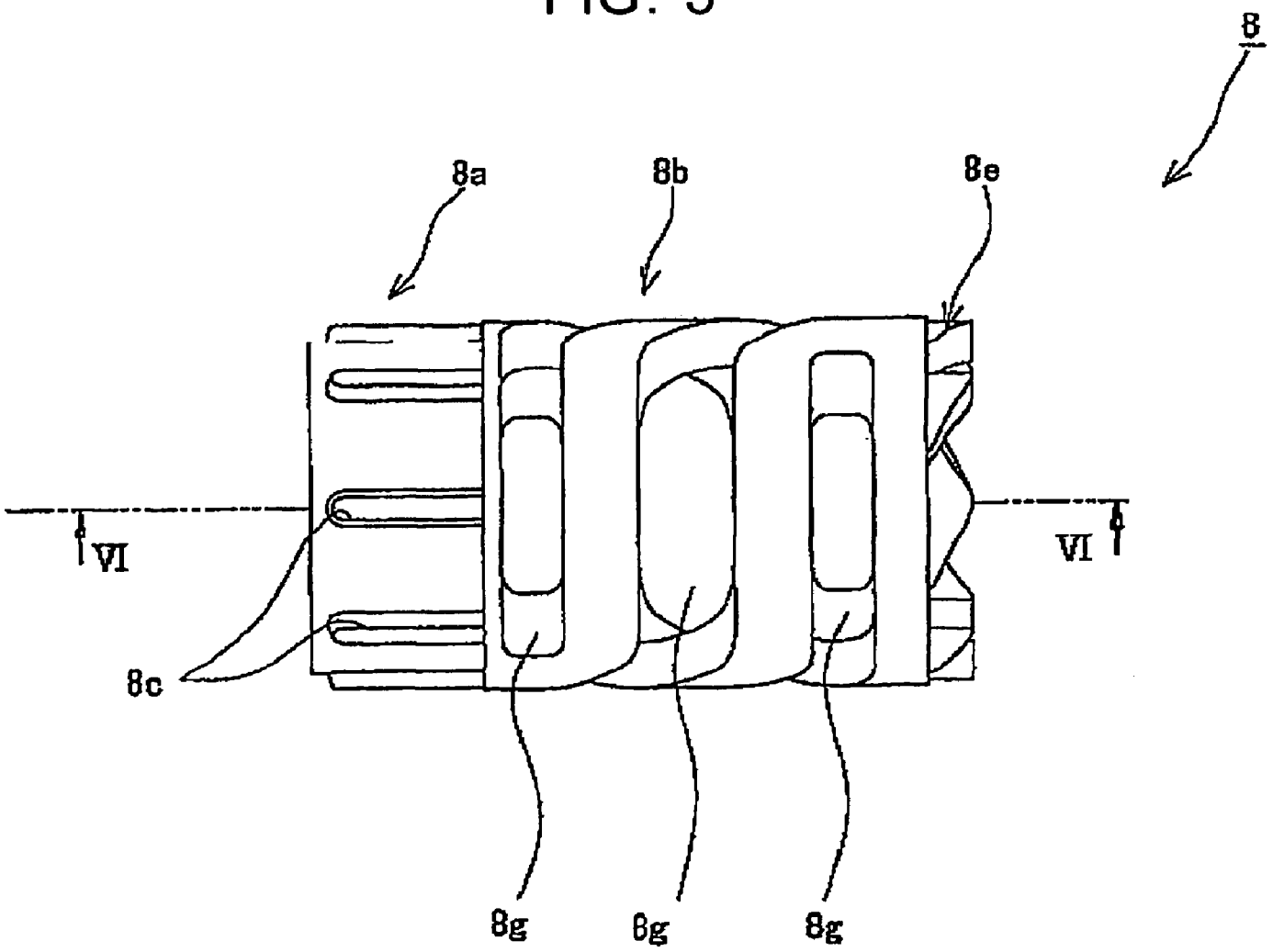
FIG. 5 is a side view of the tubular body shown in FIGS. 3 and 4.
Figure 6:
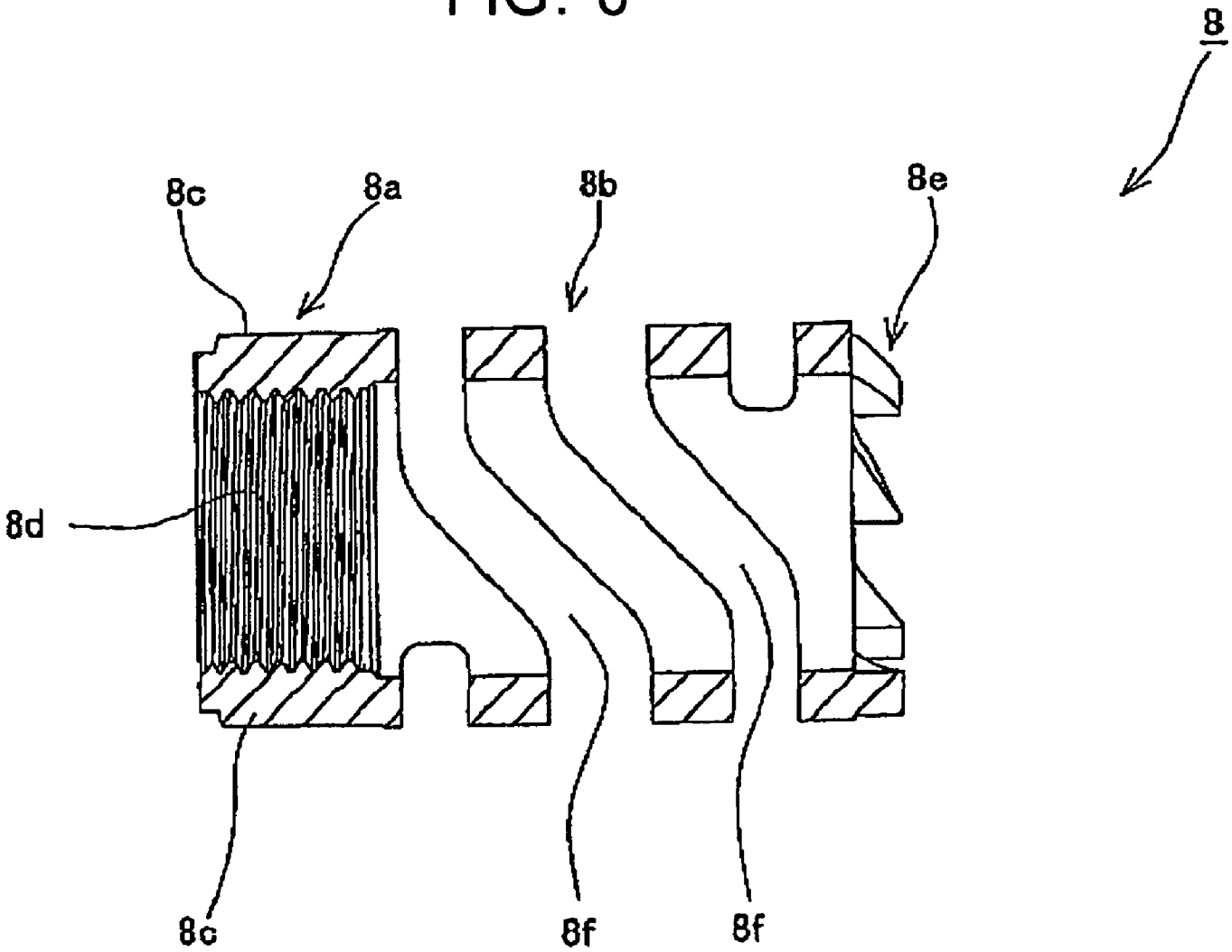
FIG. 6 is a view as seen from an arrow VI—VI in FIG. 5.
Figure 7:
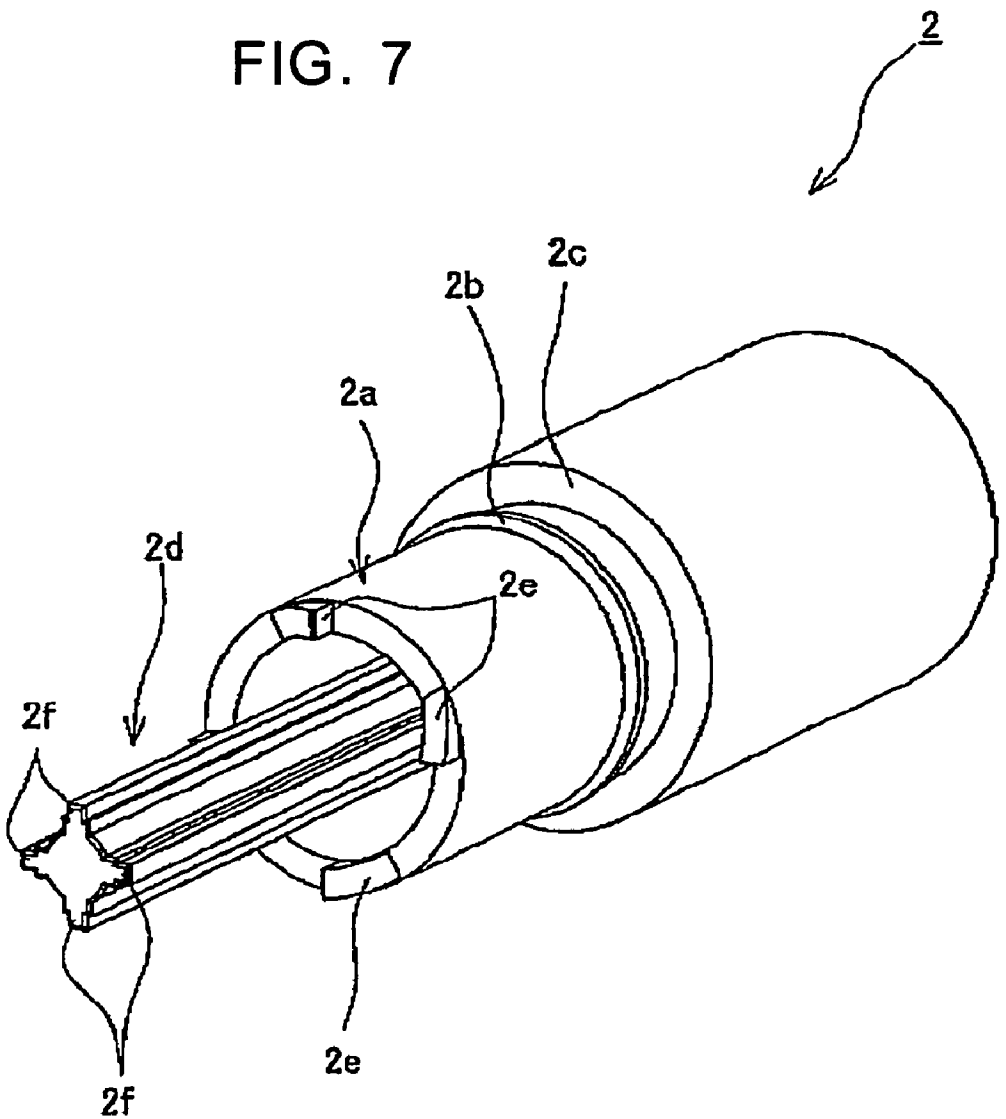
FIG. 7 is a forward perspective view showing an operating tube in FIGS. 1 and 2.
Figure 8:
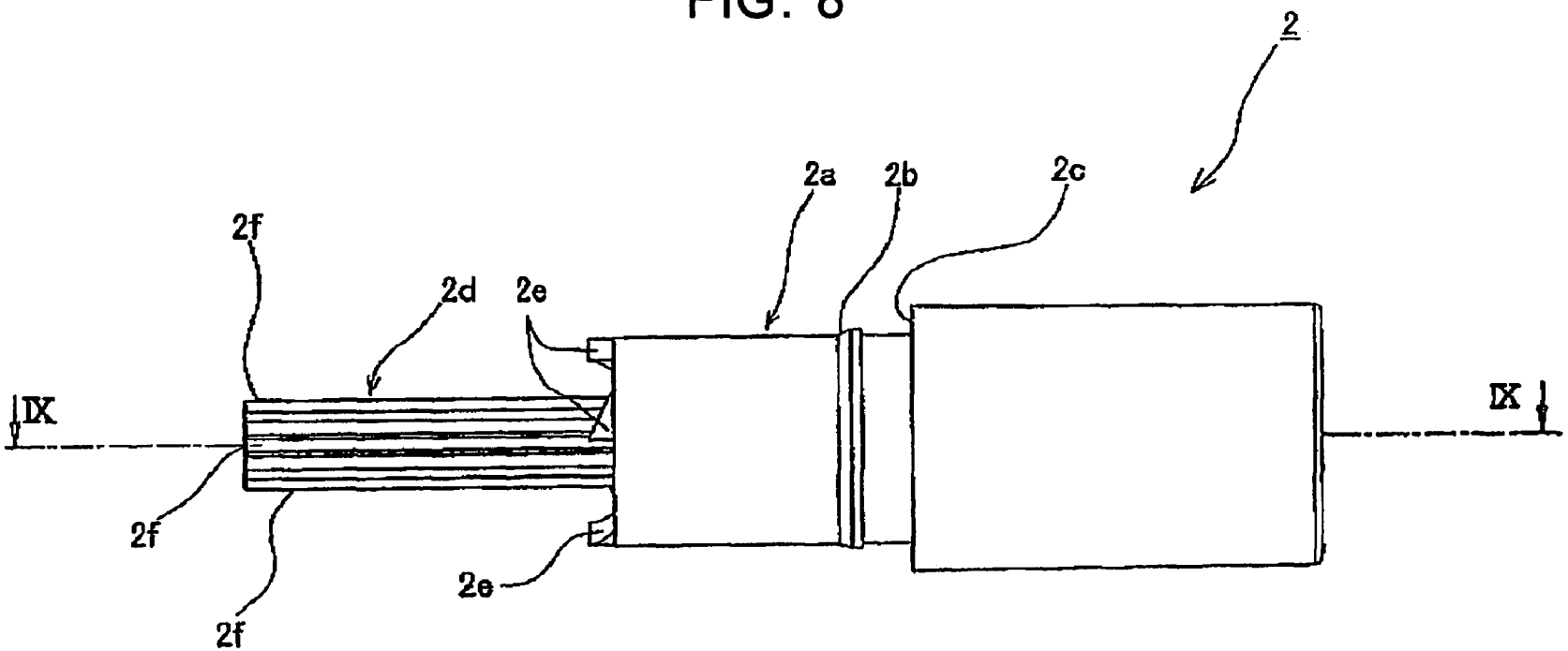
FIG. 8 is a side view of the operating tube shown in FIG. 7.
Figure 9:
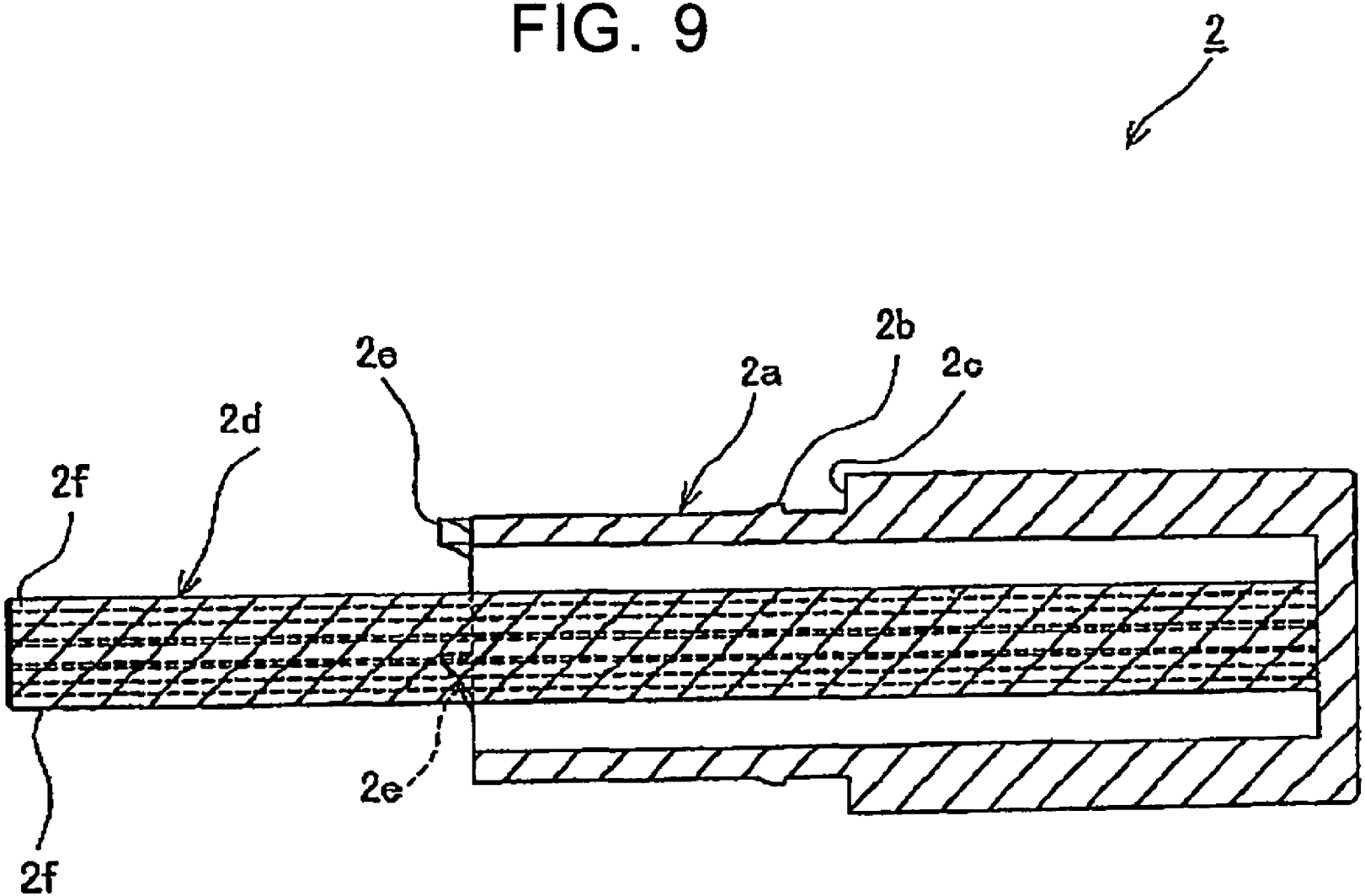
FIG. 9 is a view as seen from an arrow IX—IX in FIG. 8.

A description will be given below of a preferable embodiment of a movable body feeding apparatus in accordance with the present invention with reference to FIGS. 1 to 18. In this case, in each of the drawings, the same reference numerals are attached to the same elements and an overlapping description will be omitted. FIGS. 1 to 9 show a first embodiment in accordance with the present invention, and FIGS. 10 to 18 show a second embodiment in accordance with the present invention, respectively. FIGS. 1 and 2 are respective drawings showing a liquid filler extruding container to which the movable body feeding apparatus in accordance with the first embodiment of the present invention is applied, FIGS. 3 to 6 are respective drawings of a tubular body, and FIGS. 7 to 9 are respective views of an operating tube. The liquid filler extruding container in accordance with the present embodiment receives a liquid filler and can be appropriately extruded by a user. The liquid filler can be a lip color, a lip gloss, an eye color, an eye liner, cosmetic lotion, a cleaning solvent, a nail enamel, a nail care solution, a nail enamel remover, a mascara, an anti-aging, a hair color, a hair cosmetic, an oral care, a massage oil, a keratotic plugging reducer, an ink for a writing instrument such as a marking pen or the like, a liquid drug medicine, a slurry, a shoe polish and the like.

As shown in FIGS. 1 and 2, a liquid filler extruding container 100 is provided with a main body tube 1, an operating tube 2 which is provided in a rear end portion of the main body tube 1 so as to be relatively rotatable, a rod-like movable body 4 which is received within the main body tube 1 and the operating tube 2, is provided with a piston 3 in a leading end portion and moves to a leading end side of the main body tube 1 in the case that the main body tube 1 and the operating tube 2 are relatively rotated, a ratchet mechanism 5 which allows one-way rotation in synchronization with the relative rotation so as to move the moving body 4 to the leading end side of the main body tube 1, a filling region 6 which is defined within the main body tube 1 and in which a liquid filler L is filled, and a brush (an applying body) 7 which is provided in the leading end portion of the main body tube 1 and is provided for applying the liquid filler L extruded on the basis of a movement of the movable body 4 to the leading end side of the main body tube 1.

The main body tube 1 is structured in a cylindrical shape, is provided with a leading end tube portion 1*a* having a small outer diameter in the leading end side, and is provided with a rear end tube portion 1*b* having a large inner diameter in a rear end side. A plurality of protrusions 1*e* for connecting a tubular body 8 mentioned below so as to be synchronously rotatable (so as not to be rotatable) are formed at a position close to a step portion (an inclined step portion) 1*d* of the rear end tube portion 1*b*, in an inner peripheral surface of the main body tube 1, so as to extend at a predetermined length in an axial direction and be arranged uniformly, and an annular groove portion 1*f* for attaching the operating tube 2 so as to be relatively rotatable is formed at a position close to a rear end surface of the main body tube 1.

The operating tube 2 is structured, as shown in FIGS. 7 to 9, in a closed-end cylindrical shape, is provided with a leading end tube portion 2*a* having a small outer diameter in a leading end side, and is provided with an annular protruding portion 2*b* for attaching to the main body tube 1 in an outer peripheral surface of the leading end tube portion 2*a*.

A shaft body 2*d* is provided straightly in a center of a bottom portion of the operating tube 2 so as to be directed to the leading end side. The shaft body 2*d* is structured, as shown in FIG. 7, in an approximately cross shape in a transverse section, and a protrusion 2*f* (an engaging portion of the operating tube 2) corresponding to a leading end portion of the cross shape and a step-shaped leading end is structured as a rotation prevention constituting a synchronous rotating mechanism (a rotation preventing mechanism) of the movable body 4.

Further, the operating tube 2 is provided with a plurality of ratchet gears 2*e* constituting a ratchet mechanism protruding in a leading end side at approximately uniform spaced positions along a peripheral direction in a leading end surface of the leading end tube portion 2*a*, as shown in FIGS. 7 to 9.

The operating tube 2 is structured, as shown in FIGS. 1 and 2, such that the leading end tube portion 2*a* thereof is inserted to the rear end tube portion 1*b* of the main body tube 1, the step portion 2*c* of the leading end tube portion 2*a* is struck against the rear end surface of the main body tube 1, and the annular protruding portion 2*b* thereof is engaged with the annular groove portion 1*f* of the main body tube 1, thereby being connected to the main body tube 1 so as to be relatively rotatable.

The movable body 4 is provided with two flat surface portions (not shown) formed so as to be opposed to an outer peripheral surface of the cylinder body all along an approximately entire length thereof, and is provided with a male screw 4*b* extending in an axial direction and constituting an engaging mechanism in a circular arc surface except the two flat surface portions on the outer peripheral surface of the movable body 4. The movable body 4 is provided with a plurality of protrusions 4*d* arranged so as to protrude to an inner side in a radial direction and extending in an axial direction, at approximately uniform spaced positions along a peripheral direction on an inner peripheral surface thereof, as a rotation prevention constituting the synchronous rotating mechanism. Further, a piston 3 sliding in the filling region 6 of the main body tube 1 in a watertight manner is attached to a leading end portion of the movable body 4.

Further, as shown in FIG. 1, the movable body 4 is outside inserted to the shaft body 2*d* of the operating tube 2, and the protrusion 2*f* in the leading end of the shaft body 2*d* formed in the approximately cross shape enters into a portion between the protrusions 4*d* and 4*d* in the peripheral direction so as to be positioned in a pinched manner, whereby the movable body 4 is engaged with the operating tube 2 (the shaft body 2*d*) so as to be synchronously rotatable (be non-rotatable) and be slidable in the axial direction. Accordingly, the synchronous rotating mechanism of the movable body 4 is structured. In this case, the movable body 4 may be structured such that the outer peripheral surface is formed in a circular shape and the male screw 4*b* is provided in the outer peripheral surface.

In this case, particularly in accordance with the present embodiment, the tubular body 8 is provided as a part in a side of the main body tube 1 structuring the engaging mechanism and the ratchet mechanism. The tubular body 8 is constituted by an injection molded product integrally molded with a resin, and is structured in an approximately cylindrical shape as shown in FIGS. 3 to 6. Inner and outer diameters thereof are set to be approximately equal to inner and outer diameters of the leading end tube portion 2*a* of the operating tube 2, as shown in FIGS. 1 and 2.

As shown in FIGS. 3 to 6, the tubular body 8 has a thread tube 8*a* in a rear end portion thereof, has a ratchet gear 8*e* in a leading end portion thereof, and has a compression spring 8*b* serving as an elastic body connecting the leading end portion and the rear end portion so as to be integrally formed.

The thread tube 8*a* is provided with a plurality of protrusions (engaging portions of the thread tube 8*a*) 8*c* extending in the axial direction and engaging with the main body tube 1 so as to be synchronously rotatable, at approximately uniform spaced positions along a peripheral direction on an outer peripheral surface thereof, and is provided with a female thread 8*d* extending in the axial direction and constituting the engaging mechanism of the movable body 4, on an inner peripheral surface thereof.

A plurality of ratchet gears 8*e* are arranged at approximately uniform spaced positions along the peripheral direction on the rear end surface of the rear end portion so as to protrude to a rear side.

The compression spring 8*b* between the thread tube 8*a* and the ratchet gear 8*e* is continuously alternately provided with a spiral slit 8*f* (refer to FIG. 6) and an annular slit 8*g* (refer to FIG. 5) on the peripheral surface, and energizes the pressed ratchet gear 8*e* against the pressing force on the basis of the slits 8*f* and 8*g*. The ratchet mechanism in a side of the main body tube 1 is structured by the compression spring 8*b* and the ratchet gear 8*e*.

As shown in FIGS. 1 and 2, the tubular body 8 provided with the thread tube 8*a*, the compression spring 8*b* and the ratchet gear 8*e* is arranged so as to be pinched between the step portion (the inclined step portion) 1*d* of the inner peripheral surface of the main body tube 1 and the leading end surface of the leading end tube portion 2*a* of the operating tube 2, in such a manner that the movable body 4 passes through an inner side thereof, and the protrusion 8*c* on the outer peripheral surface of the thread tube 8*a* enters into the portion between the protrusions 1*e* and 1*e* on the inner peripheral surface of the rear end tube portion 1*b* of the main body tube 1 so as to be engaged, whereby the tubular body 8 is connected to the main body tube 1 so as to be synchronously rotatable. Further, the ratchet gear 8*e* in the rear end portion thereof is pressed on the basis of the energizing force of the compression spring 8*b* so as to be set to the engaging state with the ratchet gear 2*e* of the operating tube 2, and the female thread 8*d* on the inner peripheral surface of the thread tube 8*a* is set to the engaging state with the male screw 4*b* on the outer peripheral surface of the movable body 4.

Further, the engaging mechanism is structured by the male screw 4*b* of the movable body 4 and the female thread 8*d* of the tubular body 8, the synchronous rotating mechanism (the rotation preventing mechanism) is structured by the rotation prevention (the leading end protrusion) 2*f* of the shaft body 2*d* and the rotation prevention (the protrusion) 4*d* of the movable body 4, the ratchet mechanism 5 allowing the rotation in one direction (the forward moving direction of the movable body 4) is structured by the ratchet gear 8*e* of the tubular body 8, the ratchet gear 2*e* of the operating tube 2 and the compression spring 8*b*, and the movable body feeding apparatus 10 is structured by the engaging mechanism, the synchronous rotating mechanism and the ratchet mechanism 5.

Further, the main body tube 1 is provided with a pipe member 11 structured in an approximately cylindrical shape and having a pipe portion 11*a* in a leading end thereof, a brush holder 12 structured in a tapered approximately cylindrical shape, and a brush 7 formed by bundling and welding respective rear end portions of brushes, in a leading end side thereof. The pipe member 11 is structured such that a rear end portion thereof is inside inserted and attached to the leading end tube portion 1*a* of the main body tube 1, the filling region 6 in which the liquid filler L is filled is defined in the rear side thereof and until the piston 3 as shown in FIG. 1, and the liquid filler L from the filling region 6 is supplied (discharged) to the brush 7. In this case, a ball 9 for agitating the liquid filler L is arranged in the filling region 6.

The brush 7 is inside inserted to the brush holder 12 so as to be firmly fixed in such a manner that the leading end portion thereof protrudes from a leading end of the brush holder 12, and the brush holder 12 provided with the brush 7 is structured such that a rear end portion thereof is inside inserted to the leading end tube portion 1*a* of the main body tube 1 and outside inserted to the pipe member 11, thereby being attached to the pipe member 11. In this state, the pipe member 11 is structured such that the pipe portion 11*a* thereof is inserted until a middle of the brush 7, and is set in a state in which the leading end of the pipe portion 11*a* is positioned near the leading end surface of the brush holder 12. The brush 7 and the brush holder 12 are covered and protected by a cap 14 detachably attached to the leading end tube portion 1*a* of the main body tube 1, as shown in FIG. 1.

In the liquid filler extruding container 100 having the structure mentioned above, when the user relatively rotates the main body tube 1 and the operating tube 2, a pair of ratchet gears 2*e* and 8*e* relatively rotate synchronously, a sense of resistance is given to the user by the ratchet mechanism 5 every time when the ratchet gears 2*e* and 8*e* are engaged with each other, the movable body 4 is sequentially fed to the leading end side by the movable body feeding apparatus 10, and the liquid filler L in the filling region 6 is sequentially extruded to the leading end side by the piston 3 in the leading end of the fed movable body 4 so as to be discharged to the brush 7 via the pipe member 11 and be supplied for a use.

In accordance with the movable body feeding apparatus 10 structuring the liquid filler extruding container 100 as mentioned above, since there is employed the tubular body 8 formed by integrally molded the thread tube, the ratchet gear in the side of the main body tube and the elastic body, that is, there is employed the tubular body 8 having the thread tube 8*a* constituting the engaging mechanism in the side of main body tube 1 in the leading end portion, having the ratchet gear 8*e* in the side of the main body tube 1 in the rear end portion, having the compression spring 8*b* connecting the leading end portion 8*a* and the rear end portion 8*e* and integrally formed with the resin, the number of the parts is reduced, and the manufacturing process such as the molding, the assembling or the like is easily executed. Accordingly, it is possible to achieve a low cost of the movable body feeding apparatus 10.

In this case, in accordance with the conventional apparatus described in Japanese Unexamined Patent Publication No. 2000-262324, since the structure is made such that a pair of ratchet gears are arranged between the engaging mechanism in the side of the main body tube and the compression coil spring, it is necessary to separate the engaging mechanism side and the compression coil spring side to require three parts (a plurality of parts), so that the number of the parts is increased, and the manufacturing process such as the molding, the assembling or the like is complicated, however, in accordance with the present embodiment, such the problem can be solved as mentioned above.

Further, in the movable body feeding apparatus 10 in accordance with the present embodiment, the structure is made such that the rotation prevention (the leading end protrusion) 2*f* in the side of the operating tube 2, the engaging mechanism (the female thread 8*d* of the tubular body 8) in the side of the main body tube 1, and the ratchet mechanism 5 are overlapped in a direction orthogonal to the axial direction (the forward moving direction of the movable body 4), the entire length can be made shorter and a compact structure can be achieved, in comparison with the movable body feeding apparatus described in Japanese Unexamined Patent Publication No. 2000-262324. Alternatively, on the assumption that the entire length is fixed, an increase of the volumetric capacity of the liquid filler can be achieved.

In this case, in the present embodiment, the applying body attached to the leading end of the liquid filler extruding container 100 is constituted by the brush 7, however, for example, a sponge, a projection group, a porous body, a mere single hole or the like may be employed.

Figure 10:
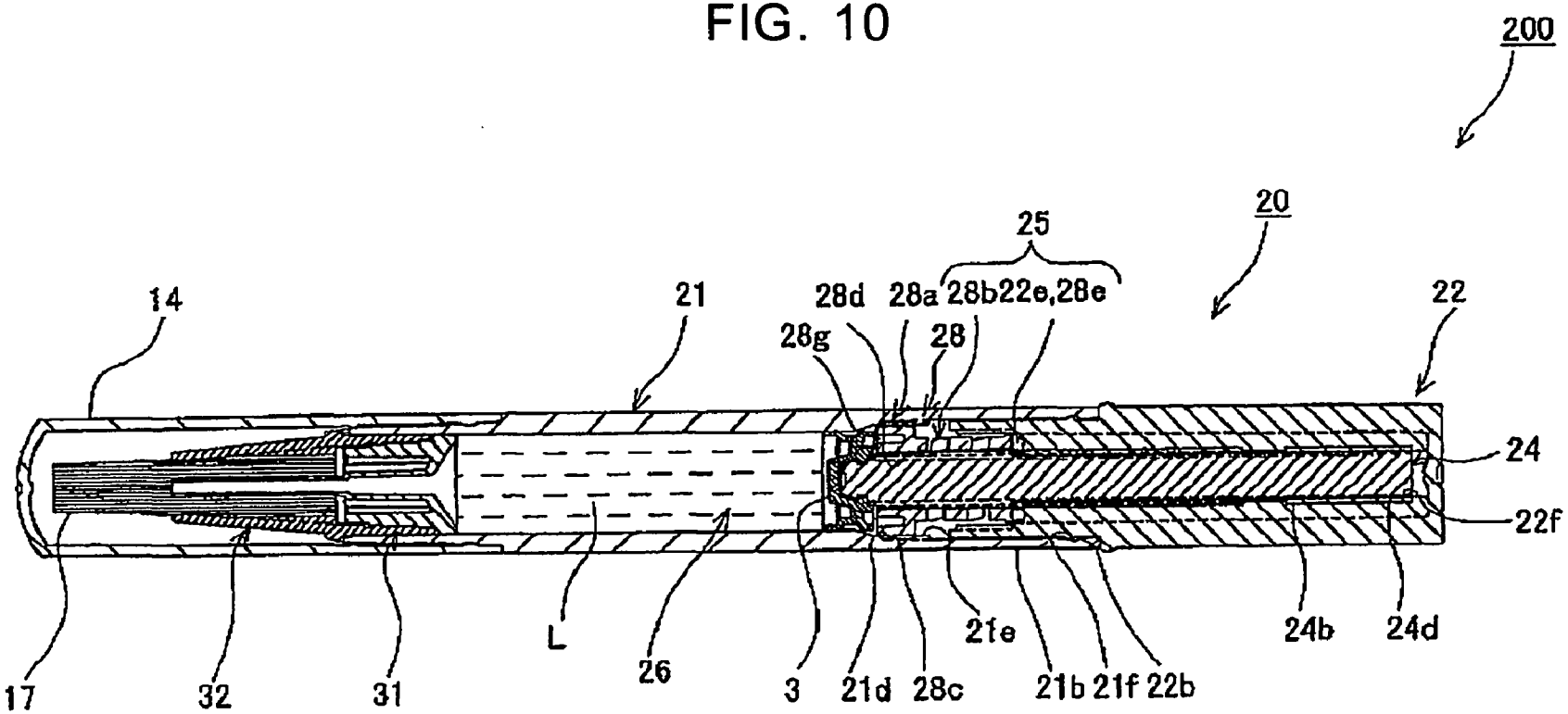
FIG. 10 is a cross sectional view showing a liquid filler extruding container to which a movable body feeding apparatus in accordance with a second embodiment of the present invention is applied, and shows a state before feeding the movable body.
Figure 11:
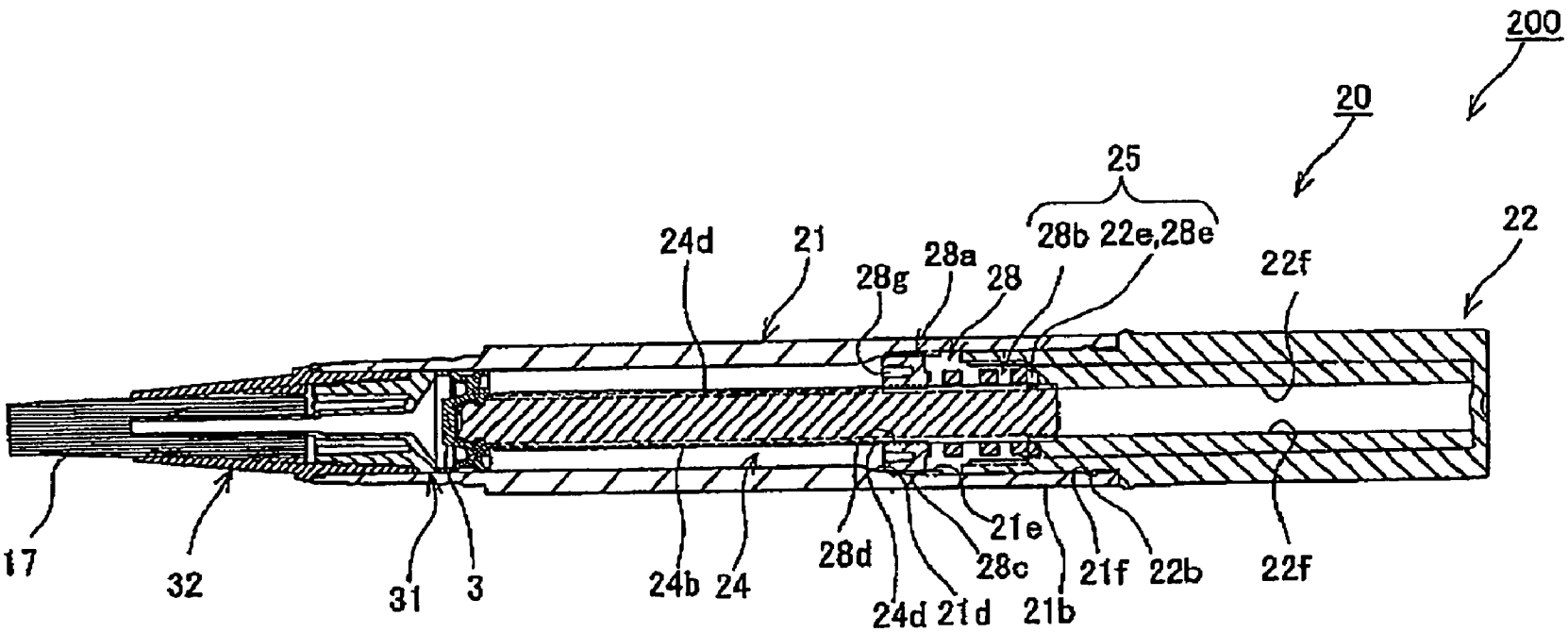
FIG. 11 is a cross sectional view showing the liquid filler extruding container to which the movable body feeding apparatus in accordance with the second embodiment of the present invention is applied, and shows a state in which the movable body is fed to a forward movement limit.
Figure 12:
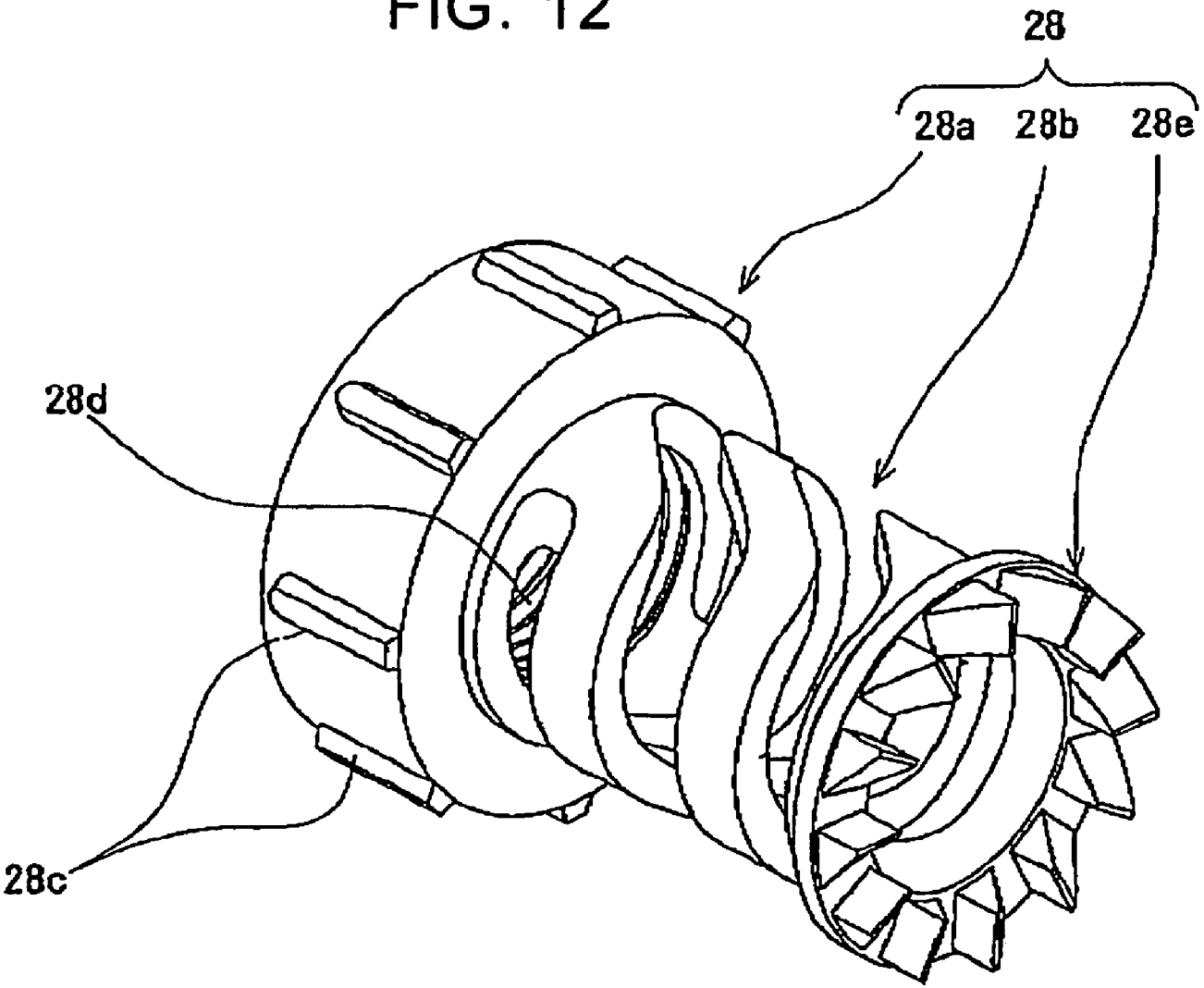
FIG. 12 is a rearward perspective view of the tubular body in FIGS. 10 and 11.
Figure 13:
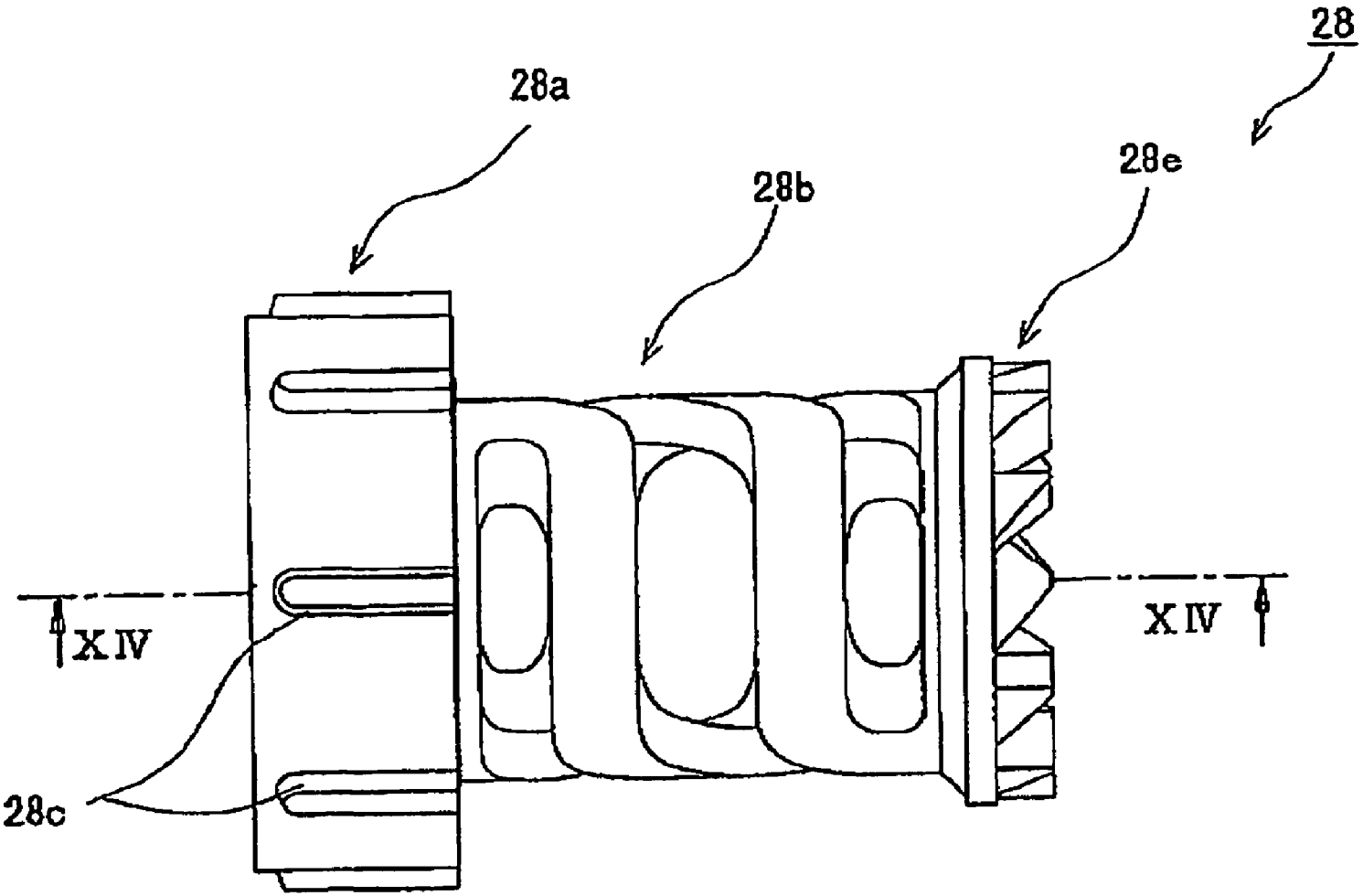
FIG. 13 is a side view of the tubular body shown in FIG. 12.
Figure 14:
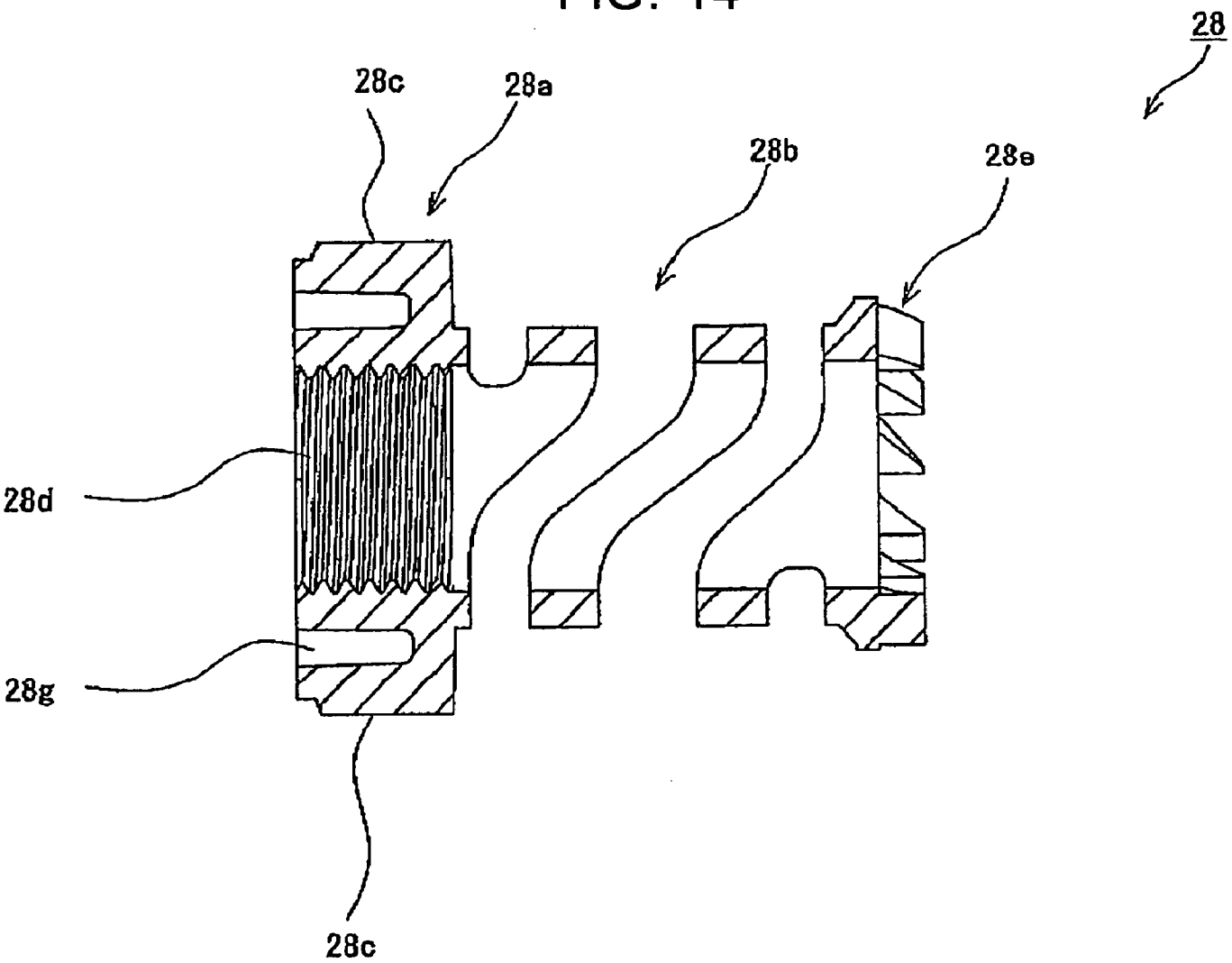
FIG. 14 is a view as seen from an arrow XIV—XIV in FIG. 13.
Figure 15:
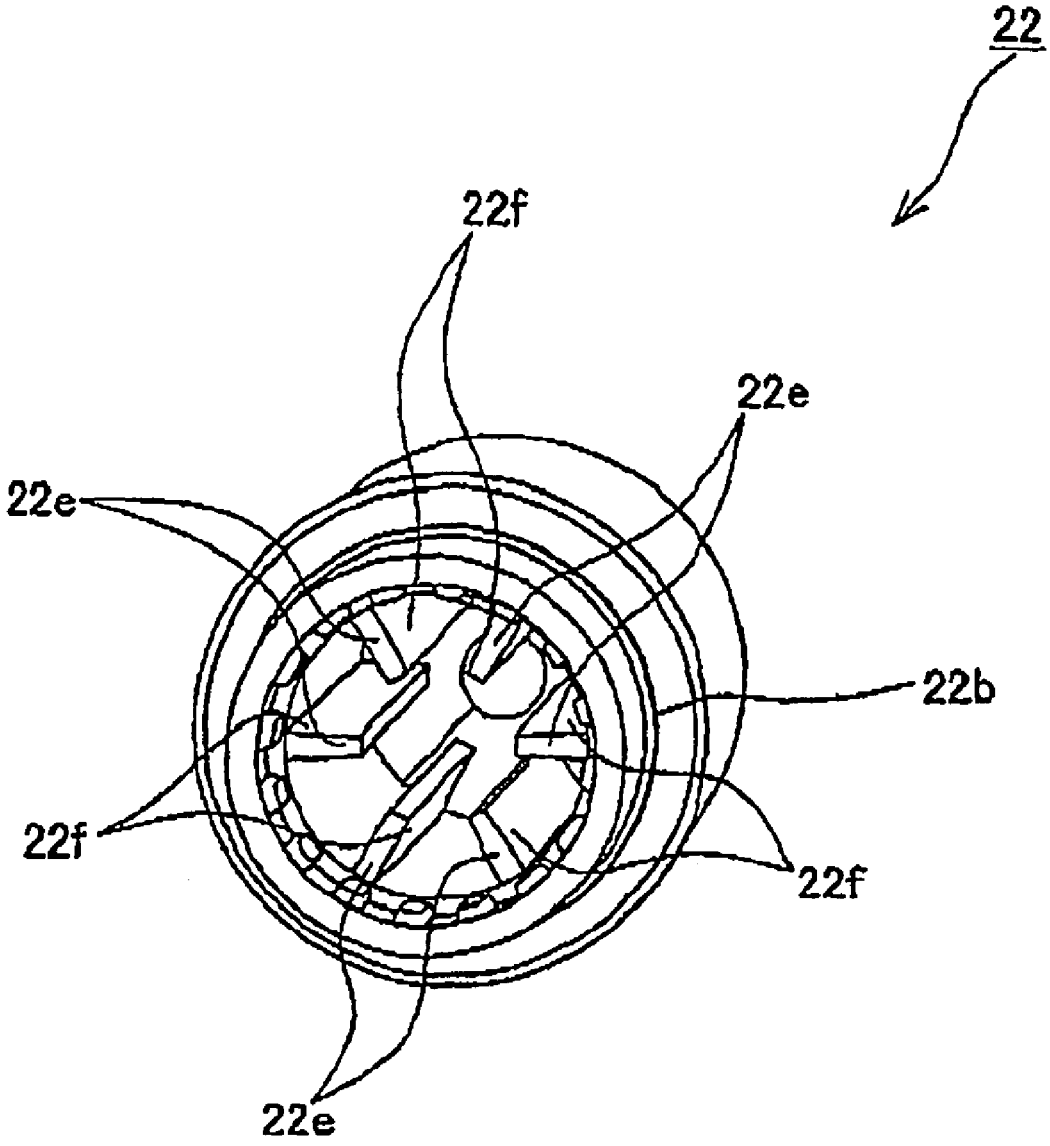
FIG. 15 is a forward perspective view showing an operating tube in FIGS. 10 and 11.
Figure 16:
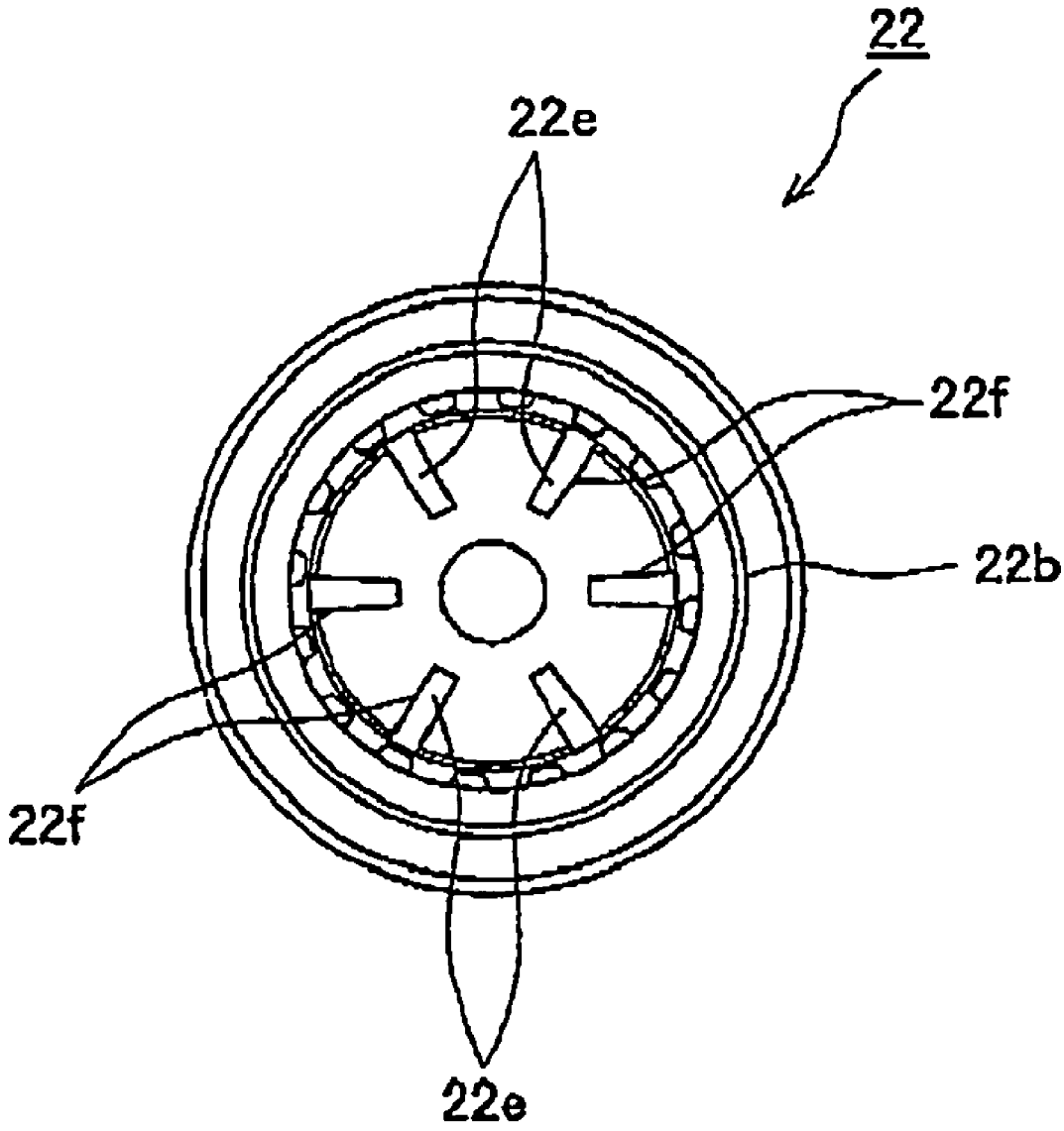
FIG. 16 is a front view of the operating tube shown in FIG. 15.
Figure 17:
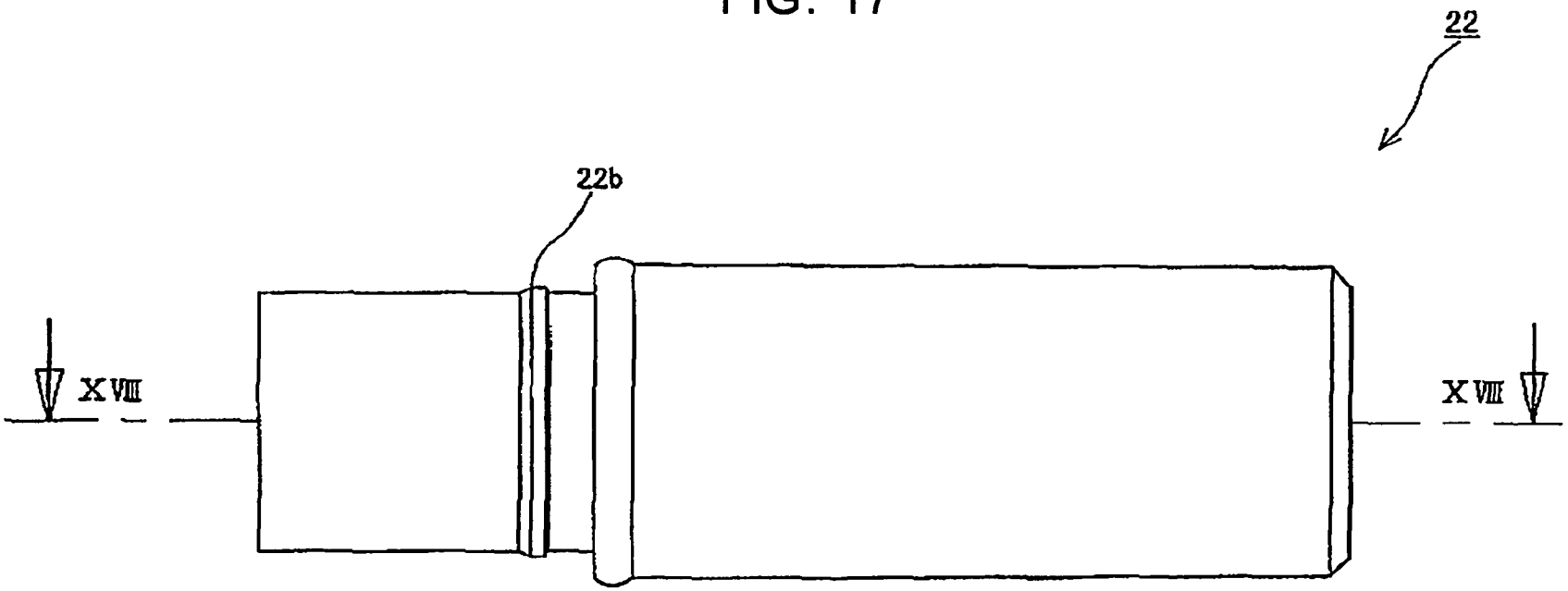
FIG. 17 is a side view of the operating tube shown in FIGS. 15 and 16.
Figure 18:
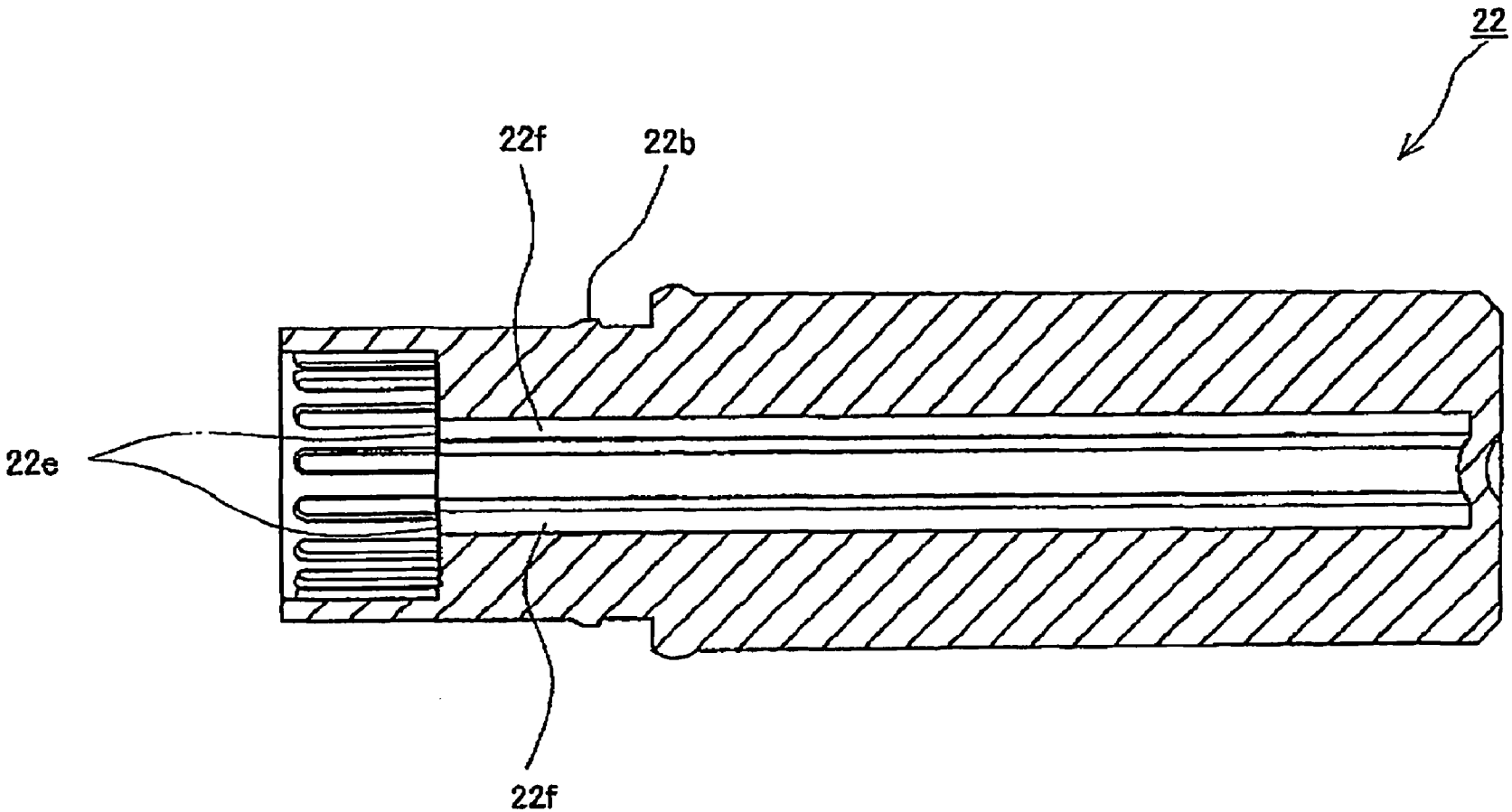
FIG. 18 is a view as seen from an arrow XVIII—XVIII in FIG. 17.

FIGS. 10 and 11 are respective views showing a liquid filler extruding container to which a movable body feeding apparatus in accordance with a second embodiment of the present invention is applied, FIGS. 12 to 14 are respective views of a tubular body, and FIGS. 15 to 18 are respective views of an operating tube.

As shown in FIGS. 10 and 11, a liquid filler extruding container 200 provided with a movable body feeding apparatus 20 in accordance with the second embodiment is provided with a cylindrical main body tube 21, a closed-end cylindrical operating tube 22, and a movable body 24. In the same manner as the container described in Japanese Unexamined Patent Publication No. 2000-262324, the cylindrical main body tube 21 is provided with a filling region 26 in which the liquid filler L is filled, in an inner portion thereof. As shown in FIGS. 10, 11 and 15 to 18, the closed-end cylindrical operating tube 22 is structured such that an annular protruding portion 22*b* provided in an outer peripheral surface thereof is engaged with an annular groove portion 21*f* of a rear end tube portion 21*b* of the main body tube 21, thereby being provided in a rear end portion of the main body tube 21 so as to be relatively rotatable, and a plurality of protrusions 22*f* (engaging portions of the operating tube 22) extending in an axial direction at approximately uniform spaced positions along a peripheral direction of an inner peripheral surface thereof and serving as a rotation prevention structuring a synchronous rotating mechanism (a rotation preventing mechanism) of the movable body 24 are formed so as to protrude to an inner side in a radial direction. As shown in FIGS. 10 and 11, the movable body 24 is structured such that the movable body is received in the operating tube 22 and the main body tube 21, and is provided with two flat surface portions (not shown) formed so as to oppose to an outer peripheral surface all along an approximately entire length of a column body, a male screw 24*b* constituting an engaging mechanism is formed in a circular arc surface except two flat surface portions of the outer peripheral surface so as to extend in an axial direction, a recessed groove 24*d* serving as a rotation prevention to which a protrusion 22*f* serving as a rotation prevention of the operating tube 22 entered so as to be engaged is formed in the opposing circular arc surface in such a manner as to extend in an axial direction, and the movable body 24 is engaged so as to be synchronously rotatable (be non-rotatable) with respect to the operating tube 22 (the protrusion 22*f*) and be slidable in the axial direction. The main body tube 21, the operating tube 22 and the movable body 24 have the same structure as that described in Japanese Unexamined Patent Publication No. 2000-262324. In this case, a pipe member 31, a brush holder 32 and a brush 17 having approximately the same functions as those of the first embodiment are attached to a leading end portion of the main body tube 21.

In this case, the movable body feeding apparatus 20 in accordance with the second embodiment is different from the apparatus described in Japanese Unexamined Patent Publication No. 2000-262324 in the following point. In place of three elements in the apparatus described in Japanese Unexamined Patent Publication No. 2000-262324, that is, the first tubular body structuring the engaging mechanism in the side of the main body tube 1 and provided with one of the ratchet gears, the second tubular body provided with the other of the ratchet gears, and the compression coil spring energizing the second tubular body toward the first tubular body in such a manner that the ratchet gears of the first and second tubular bodies are engaged with each other, a tubular body 28 having these functions and integrally molded with a resin is employed.

The tubular body 28 is structured, as shown in FIGS. 12 to 14, such that a basic structure is the same as that of the tubular body 8 in accordance with the first embodiment, however, inner and outer diameters of a compression spring 28*b* serving as an elastic body and a ratchet gear 28*e* in a rear end portion are set to be approximately equal to inner and outer diameters of the protrusion 22*f* of the operating tube 22, as shown in FIGS. 10 and 11, and on the other hand, in order to make the tubular body 28 to be freely engaged with the main body tube 21, an outer diameter of a thread tube 28*a* in a leading end portion is set to be larger than an outer diameter of the compression spring 28*b* and the ratchet gear 28*e*, as shown in FIGS. 10 to 14. In this case, an annular groove portion 28*g* depressed from a leading end surface at a position surrounding a female thread 28*d* of the thread tube 28 is provided for uniformizing a thickness of the thread tube 28*a* and a thickness of the compression spring 28*b*, and inhibiting a thickness shrinkage (including a void), which may be generated due to a great thickness difference, from being generated.

The tubular body 28 is arranged so as to be pinched between a step portion (an inclined step portion) 21*d* formed in an inner peripheral surface of the main body tube 21 and a leading end portion of the protrusion 22*f* of the operating tube 22 in such a manner that the movable body 24 passes through an inner side thereof, as shown in FIG. 10. A protrusion 28*c* (an engaging portion of the thread tube 28*a*) on an outer peripheral surface of the thread tube 28*a* enters in to a portion between the protrusions 21*e* and 21*e* formed in an inner peripheral surface of the rear end tube portion 21*b* of the main body tube 21 so as to be engaged, whereby the tubular body 28 is connected to the main body tube 21 so as to be synchronously rotatable (be non-rotatable). Further, the ratchet gear 28*e* in the rear end portion thereof is pressed by the energizing force of the compression spring 28*b*, and a leading end portion of the protrusion 22*f* of the operating tube 22 is formed as the ratchet gear 22*e* so as to be set to the engaged state. Further, the female thread 28*d* in the inner peripheral surface of the thread tube 28*a* is set to the engaged state with the male screw 24*b* on the outer peripheral surface of the movable body 24.

Further, the engaging mechanism is structured by the male screw 24*b* of the movable body 24 and the female thread 28*d* of the tubular body 28, the synchronous rotating mechanism (the rotation preventing mechanism) is structured by the rotation prevention (the protrusion) 22*f* of the operating tube 22 and the rotation prevention (the recessed groove) 24*d* of the movable body 24, the ratchet mechanism 25 is structured by the ratchet gear 28*e* of the tubular body 28, the ratchet gear 22*e* in the leading end portion of the protrusion 22*f* of the operating tube 22 and the compression spring 28*b*, and the movable body feeding apparatus 20 is structured by the engaging mechanism, the synchronous rotating mechanism and the ratchet mechanism 25.

Needless to say, the same effects as those of the movable body feeding apparatus 10 in accordance with the first embodiment can be obtained in the movable body feeding apparatus 20 in accordance with the second embodiment having the structure mentioned above.

In addition, in the second embodiment, since the leading end portion of the protrusion 22*f* corresponding to the rotation prevention with respect to the movable body 24 of the operating tube 22 is used both as the ratchet gear 22*e* and the rotation prevention (is used as it is without changing the shape of the protrusion described in Japanese Unexamined Patent Publication No. 2000-262324), it is unnecessary that the ratchet gear is independently provided in the side of the operating tube 22, and the low cost is further achieved. In this case, the structure may be of course made such that the leading end portion of the protrusion 22*f* structuring the ratchet gear 22*e* is inclined as in the ratchet gear 2*e* in accordance with the first embodiment.

The description is in particular given above of the present invention on the basis of the embodiments, however, the present invention is not limited to the embodiments mentioned above. For example, in the embodiments mentioned above, the subject to be extruded by the movable body feeding apparatus 10 or 20 is particularly preferably set to the liquid filler, however, it may be constituted by a solid cosmetic material, a semisolid cosmetic material, a gel cosmetic material or the like.

Further, the female thread and the male screw in the embodiment mentioned above may employ a thread-shaped structure having the same function.

What is claimed is:

1. A movable body feeding apparatus comprising:

a main body tube;

a thread tube which is arranged within the main body tube, is engaged with said main body tube so as to be synchronously rotatable and has a female thread formed in an inner peripheral surface thereof;

a stick-shaped movable body in which a male screw engaging with said female thread is formed in an outer peripheral surface thereof;

an operating tube which is connected to a rear end side of said main body tube so as to be relatively rotatable and is provided with an engaging portion engaging said movable body so as to be synchronously rotatable and be slidable in an axial direction;

a pair of ratchet gears which are respectively provided in a side of the threaded tube and a side of the operating tube; and an elastic body which energizes such that the ratchet gears are engaged with each other;

said movable body being sequentially fed on the basis of a relative rotation of said main body tube and said operating tube, wherein the movable body feeding apparatus is provided with a tubular body in which said thread tube, the ratchet gear in said threaded tube side and said elastic body are integrally formed.

2. A movable body feeding apparatus as claimed in claim 1, wherein said pair of ratchet gears are arranged so as to oppose in an axial direction, said elastic body is constituted by a compression spring energizing in such a manner that said ratchet gears are engaged with each other, and said tubular body is constituted by an integrally molded product with a resin, has said thread tube in a leading end portion, has said main body tube side ratchet gear in a rear end portion, is integrally formed so as to have said compression spring connecting the leading end portion and the rear end portion, and is arranged so as to be pinched between said main body tube and said operating tube in such a manner that said movable body passes through an inner side thereof.

3. A movable body feeding apparatus as claimed in claim 2, wherein the ratchet gear in said operating tube side is provided in the leading end surface of said operating tube.

4. A movable body feeding apparatus as claimed in claim 2, wherein the engaging portion of said operating tube is provided at plural number in the inner peripheral surface of said operating tube so as to protrude to an inner side in a radial direction, and the leading end portion of the engaging portion of said operating tube is formed as the ratchet gear in said operating tube side.

5. A movable body feeding apparatus as claimed in claim 1, wherein the ratchet gear in said operating tube side is provided in the leading end surface of said operating tube.

6. A movable body feeding apparatus as claimed in claim 1, wherein the engaging portion of said operating tube is provided at plural number in the inner peripheral surface of said operating tube so as to protrude to an inner side in a radial direction, and the leading end portion of the engaging portion of said operating tube is formed as the ratchet gear in said operating tube side.

* * * * *